US006368184B1

(12) United States Patent
Beckage

(10) Patent No.: US 6,368,184 B1
(45) Date of Patent: Apr. 9, 2002

(54) APPARATUS FOR DETERMINING METAL CMP ENDPOINT USING INTEGRATED POLISHING PAD ELECTRODES

(75) Inventor: Peter J. Beckage, Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 09/480,732

(22) Filed: Jan. 6, 2000

(51) Int. Cl.[7] ..... B24B 49/00; B24B 51/00
(52) U.S. Cl. ..... 451/9; 451/8; 451/550
(58) Field of Search ..... 324/71.5, 671, 324/688; 451/4, 6, 8, 9, 41, 65, 67, 527, 548, 550

(56) References Cited

U.S. PATENT DOCUMENTS

| | | | | |
|---|---|---|---|---|
| 5,081,421 A | * | 1/1992 | Miller et al. | 324/671 |
| 5,337,015 A | | 8/1994 | Lustig et al. | 324/671 |
| 5,559,428 A | | 9/1996 | Li et al. | 324/71.5 |
| 6,190,494 B1 | * | 2/2001 | Dow | 156/345 |

FOREIGN PATENT DOCUMENTS

| | | | |
|---|---|---|---|
| EP | 0325753 | 2/1989 | H01L/21/00 |
| EP | 0771611 | 7/1997 | B24B/37/04 |

* cited by examiner

*Primary Examiner*—Timothy V. Eley
(74) *Attorney, Agent, or Firm*—Williams, Morgan & Amerson, P.C.

(57) ABSTRACT

A polishing system includes a polishing tool having a platen, a polishing pad, and a controller. The platen is adapted to have the polishing pad attached thereto. The polishing pad includes a polishing surface and a back surface that is opposite the polishing surface. At least one sender electrode and at least one response electrode is disposed in the polishing pad. The controller is coupled to the polishing tool. A method includes polishing a conductive process layer of a wafer using a polishing pad of a polishing tool having at least one sender electrode and at least one response electrode disposed therein. A signal is provided to the at least one sender electrode. The signal provided to the at least one sender electrode is monitored with at least one of a group of the at least one response electrode, the at least one response electrode communicating with the at least one sender electrode through the conductive process layer of the wafer. Endpoint of the polishing process is determined based on the signal received by the at least one response electrode.

50 Claims, 10 Drawing Sheets

APPARATUS FOR DETERMINING METAL CMP ENDPOINT USING INTEGRATED POLISHING PAD ELECTRODES

BACKGROUND OF THE INVENTION

1. Field of the Invention

This invention relates generally to semiconductor processing, and more particularly, to a method and apparatus for determining metal chemical mechanical polishing (CMP) endpoint using integrated polishing pad electrodes.

2. Description of the Related Art

CMP is a widely used means of planarizing silicon dioxide as well as other types of processing layers on semiconductor wafers. Chemical mechanical polishing typically utilizes an abrasive slurry disbursed in an alkaline or acidic solution to planarize the surface of the wafer through a combination of mechanical and chemical action. Generally, a chemical mechanical polishing tool includes a polishing device positioned above a rotatable circular platen or table on which a polishing pad is mounted. The polishing device may include one or more rotating carrier heads to which wafers may be secured, typically through the use of vacuum pressure. In use, the platen may be rotated and an abrasive slurry may be disbursed onto the polishing pad. Once the slurry has been applied to the polishing pad, a downward force may be applied to each rotating carrier head to press the attached wafer against the polishing pad. As the wafer is pressed against the polishing pad, the surface of the wafer is mechanically and chemically polished.

As semiconductor devices are scaled down, the importance of chemical mechanical polishing to the fabrication process increases. In particular, it becomes increasingly important to control and determine endpoint for a polishing process (i.e., determining when a processing layer is sufficiently removed from a surface of a wafer.) Generally, a variety of known techniques may be used to determine endpoint for a polishing process. For example, during a polishing process, electrical current supplied to the rotating carrier heads of a polishing tool may be monitored. Moreover, because various processing layers of a wafer may have different coefficients of friction, the endpoint of a polishing process may be determined by changes in the current supplied to the rotating carrier heads. For example, depending upon the coefficient of friction of the underlying process layer or semiconductor substrate, an increase or decrease in the current supplied to the rotating carrier heads may signal the endpoint of a polishing process.

In addition to carrier current, optical sensors may be used to detect endpoint of a polishing process. For example, in one embodiment, openings may be defined in a polishing pad of a polishing tool, and a laser beam, originating from the platen, may be directed through the openings in the polishing pad and reflected off a polishing surface of a wafer. Once reflected, the phase angle of the reflected laser beam may be measured using optical sensors embedded in the platen of the polishing tool. Those skilled in the art will appreciate that the endpoint of the polishing process may be determined by a predetermined change in the phase angle of the reflected laser beam.

The existing endpoint detection techniques for wafer polishing processes, however, suffer from several shortcomings. For example, because of semiconductor process variations, such as surface non-uniformity of a wafer, existing control techniques may inadequately determine endpoint for a polishing process. Moreover, traditional endpoint techniques, such as carrier current, polishing pad temperature, etc., are based on bulk polishing action across the surface of the wafer. With these techniques, endpoint may be prematurely determined. For example, endpoint may be incorrectly signaled after removing only 90% of the process layer from the surface of the wafer resulting in residual unpolished process layer remaining on the surface of the wafer. In addition, other endpoint techniques, such as optical detection, "look" for endpoint based on the process layer located at the edge of the wafer. With these techniques, any residual process layer located at the center of the wafer may not be detected.

Unfortunately, the problems experienced with traditional endpoint control techniques may be exacerbated when polishing metal or other electrically conductive process layers. For example, small residual patches of metal remaining on a surface of a wafer, if not detected, may result in electrical shorts or other parametric failures in the final semiconductor devices (e.g., microprocessors, microcontrollers, memory, etc.) Moreover, such residual patches of metal or other conductive process layers, if not removed, may significantly reduce production yield, thus, increasing manufacturing costs.

The present invention is directed to overcoming, or at least reducing the effects of, one or more of the problems set forth above.

SUMMARY OF THE INVENTION

In one aspect of the present invention, a polishing system is provided. The system includes a polishing tool having a platen, a polishing pad, and a controller. The platen is adapted to have the polishing pad attached thereto. The polishing pad includes a polishing surface and a back surface that is opposite the polishing surface. At least one sender electrode and at least one response electrode is disposed in the polishing pad. The controller is coupled to the polishing tool.

In another aspect of the present invention, a method is provided. The method includes polishing a conductive process layer of a wafer using a polishing pad of a polishing tool having at least one sender electrode and at least one response electrode disposed therein. A signal is provided to the at least one sender electrode. The signal provided to the at least one sender electrode is monitored with at least one of a group of the at least one response electrode, the at least one response electrode communicating with the at least one sender electrode through the conductive process layer of the wafer. Endpoint of the polishing process is determined based on the signal received by the at least one response electrode.

BRIEF DESCRIPTION OF THE DRAWINGS

The invention may be best understood by reference to the following description taken in conjunction with the accompanying drawings, in which like reference numerals identify like elements, and in which.

Figure 1:
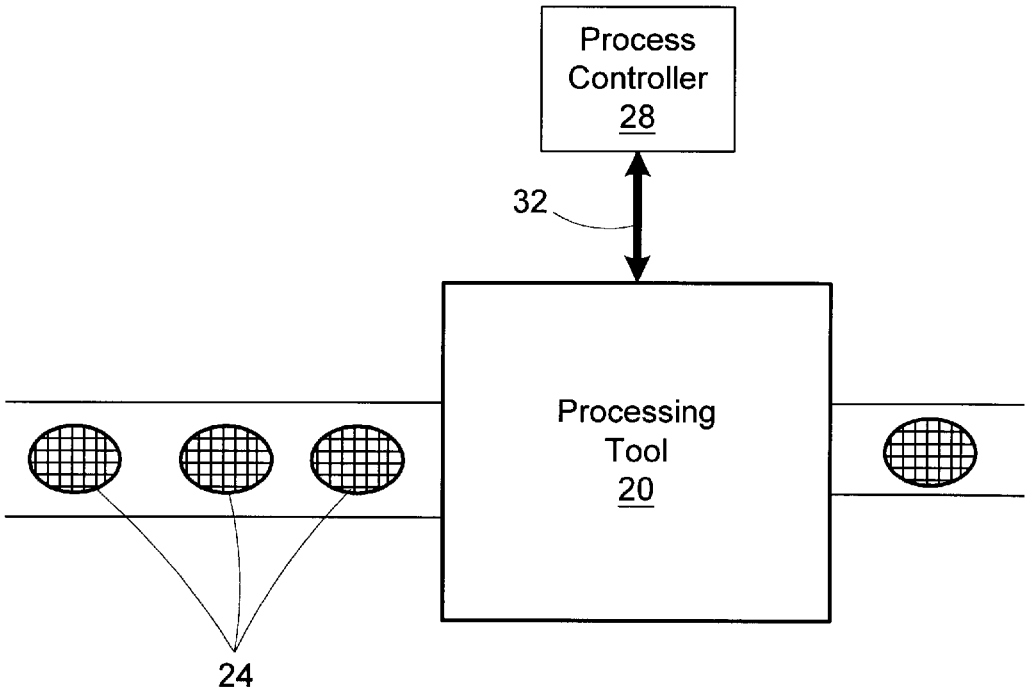
(Prior Art) Figure 1
FIG. 1 is a simplified block diagram of a processing tool used to manufacture semiconductor devices.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention is directed to a method and apparatus for determining endpoint of a semiconductor polishing process. In disclosing the present invention, reference will be made to the illustrative embodiment of the invention depicted in FIGS. 1–10. The relative sizes of the various features depicted in the drawings may be exaggerated or reduced as compared to the size of those feature sizes on actual devices. Nevertheless, the attached drawings are included to aid in obtaining an understanding of the present invention.

Referring to FIG. 1, an exemplary processing tool 20 is shown. The processing tool 20 may be used as one part of a fabrication process to manufacture semiconductor wafers 24 into functional semiconductor devices. The processing tool 20 may be controlled by a process controller 28 that may send a plurality of control signals to the processing tool on a control line 32. The process controller 28 may be comprised of a variety of devices. For example, in one embodiment, the process controller 28 may be a controller embedded inside the processing tool 20 and communicate with the processing tool 20 using protocols and interfaces provided by the manufacturer. Alternatively, the process controller 28 may be connected to a larger network of controllers and communicate with the processing tool 20 through an Advanced Process Control (APC) framework interface. For example, the processing tool 20 may be coupled to an equipment interface (not shown) that retrieves various operational data from the processing tool 20 and communicates this data to the Advanced Process Control (APC) framework. Moreover, the equipment interface may receive control signals from the APC framework that may be used to control the processing tool 20.

The semiconductor wafers 24 are generally processed in batches, which are commonly referred to as lots or batch processing. For example, a lot of wafers 24 may be comprised of twenty-five wafers. The wafers 24 within a lot progress through the manufacturing process together in an attempt to subject the wafers 24 to substantially the same manufacturing conditions, such that the resulting semiconductor devices have substantially the same performance characteristics (e.g., speed, power, etc.).

Figure 2:
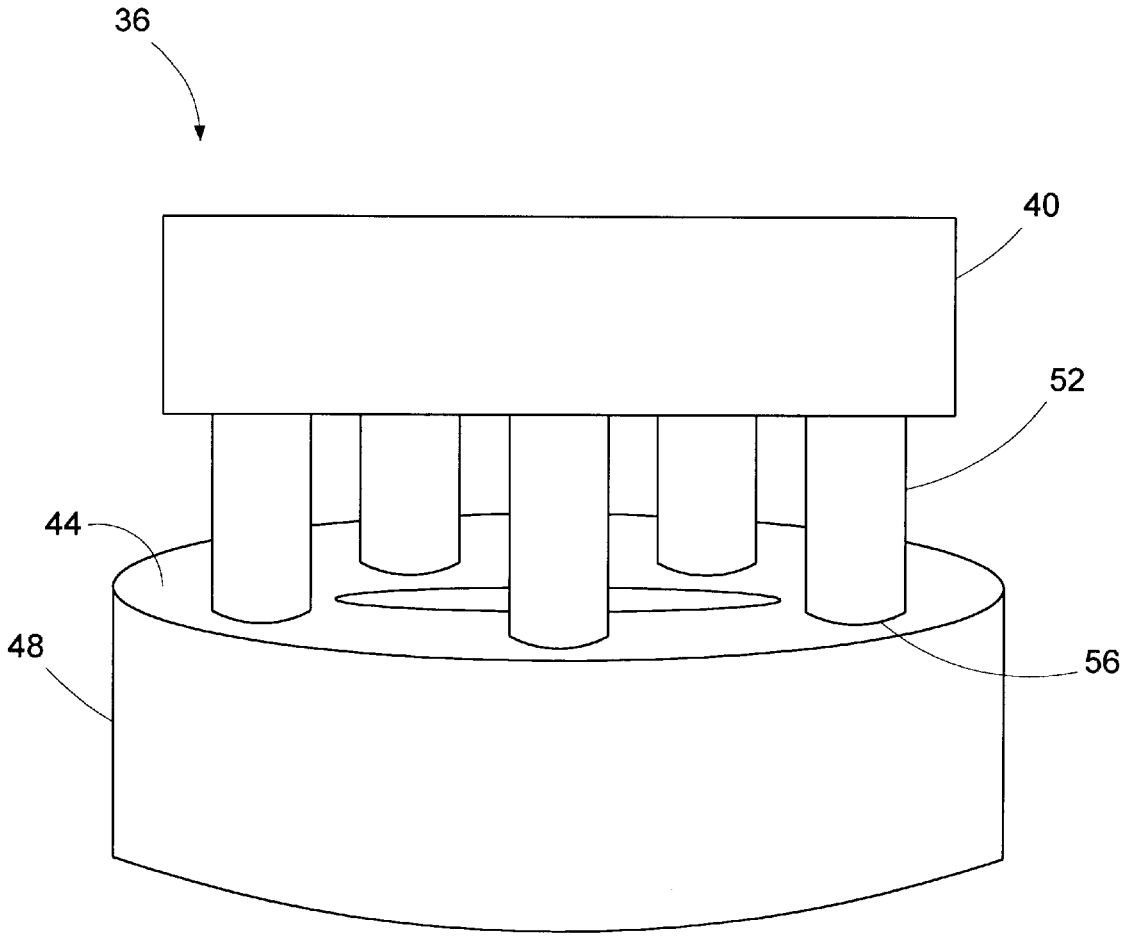
(Prior Art) Figure 2
FIG. 2 illustrates a conventional polishing tool having multiple arms.

Referring to FIG. 2, an exemplary multiple arm polishing tool 36 is shown. The exemplary polishing tool 36 may be comprised of a multi-head carrier 40 positioned above a polishing pad 44 that is mounted on a rotateable platen 48. The multi-head carrier 40 typically includes a plurality of rotateable polishing arms 52, each of which includes a carrier head 56. Wafers (not shown) may be secured to the carrier heads 56 using known techniques, such as vacuum pressure. A source of polishing fluid (not shown) may be provided to supply polishing fluid (e.g., slurry) to the polishing pad 44. Furthermore, although five polishing arms 52 are shown, the polishing tool 36 may be comprised of any number of polishing arms 52. For example, in one embodiment, the polishing tool 36 is comprised of only a single polishing arm 52, and each wafer is polished individually.

Figure 3:
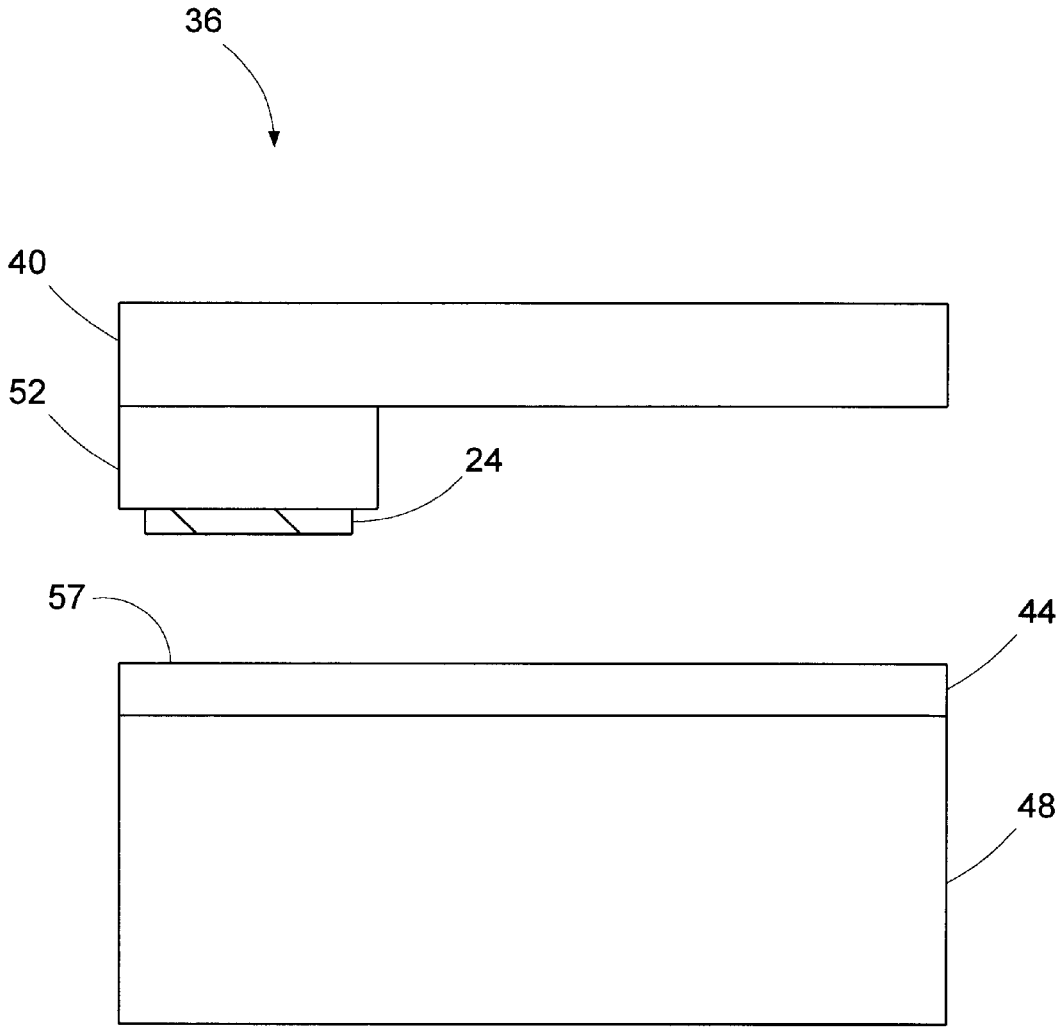
(Prior Art) Figure 3
FIG. 3 is a simplified side-view of the polishing tool illustrated in FIG. 2.

Referring to FIG. 3, a simplified side-view of the illustrative polishing tool 36 is shown. To simplify understanding the operation of the polishing tool 36, only one polishing arm 52 is illustrated. Again, the polishing pad 44 may be fixed to the rotatable platen 48. The wafer 24 is connected to the rotatable polishing arm 52, using for example vacuum pressure, and the polishing arm 52 may be connected to the carrier 40. To effectuate polishing, the polishing arm 52 may be extended such that the wafer 24 is pressed against a surface 57 of the polishing pad 44, and the platen 48 may be rotated, typically at a constant speed. Moreover, a variable downward force may be applied to the polishing arm 52, and the polishing arm 52 may be rotated and oscillated back and forth across the polishing pad 44.

Figure 4:
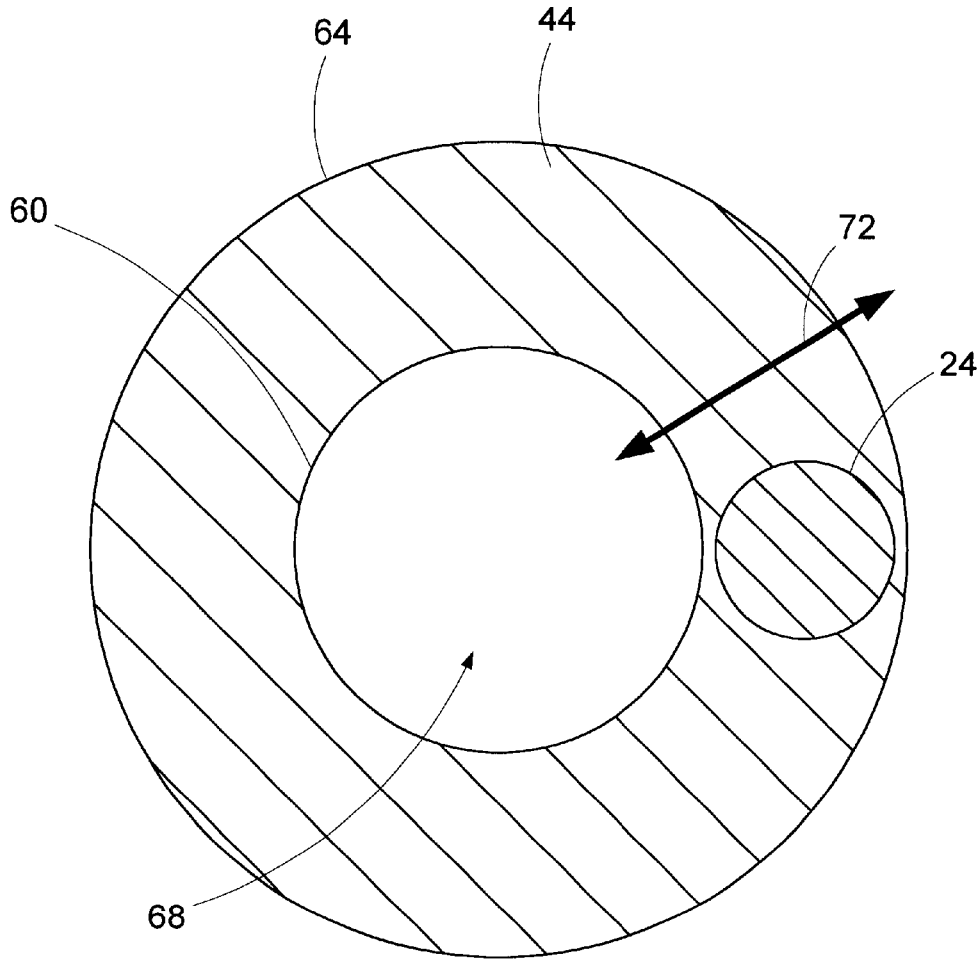
(Prior Art) Figure 4
FIG. 4 is a simplified top-view of the polishing tool, shown in FIG. 2.

Referring to FIG. 4, a top-view of the polishing pad 44, illustrated in FIGS. 2 and 3, is shown. The polishing pad 44 may include an inner edge 60, an outer edge 64, and have an opening 68 positioned therein. Moreover, the wafer 24 is shown positioned against the polishing pad 44 between the inner and outer edge 60, 64. For simplicity, the polishing arms 52 and other elements of the polishing tool 36 are not shown. In addition, those skilled in the art will appreciate that a plurality of wafers 24 may be polished at the same time, and that FIG. 4 is a simplified view of the polishing pad 44.

During the polishing process, the wafer 24 may oscillate back and forth across the polishing pad 44. The direction of the oscillation is indicated by arrow 72. Normally, the oscillation length may be adjusted such that a portion of the wafer 24 moves slightly off the inner edge 60 of the polishing pad 44 at the minimum point of oscillation and slightly off the outer edge 64 of the polishing pad 44 at the maximum point of oscillation. Moreover, the oscillation length may be adjusted, and by increasing or decreasing the portion of the wafer 24 that moves off of the polishing pad 44 at the minimum and maximum points of oscillation, the center-to-edge polish rate may be adjusted.

Figure 5:
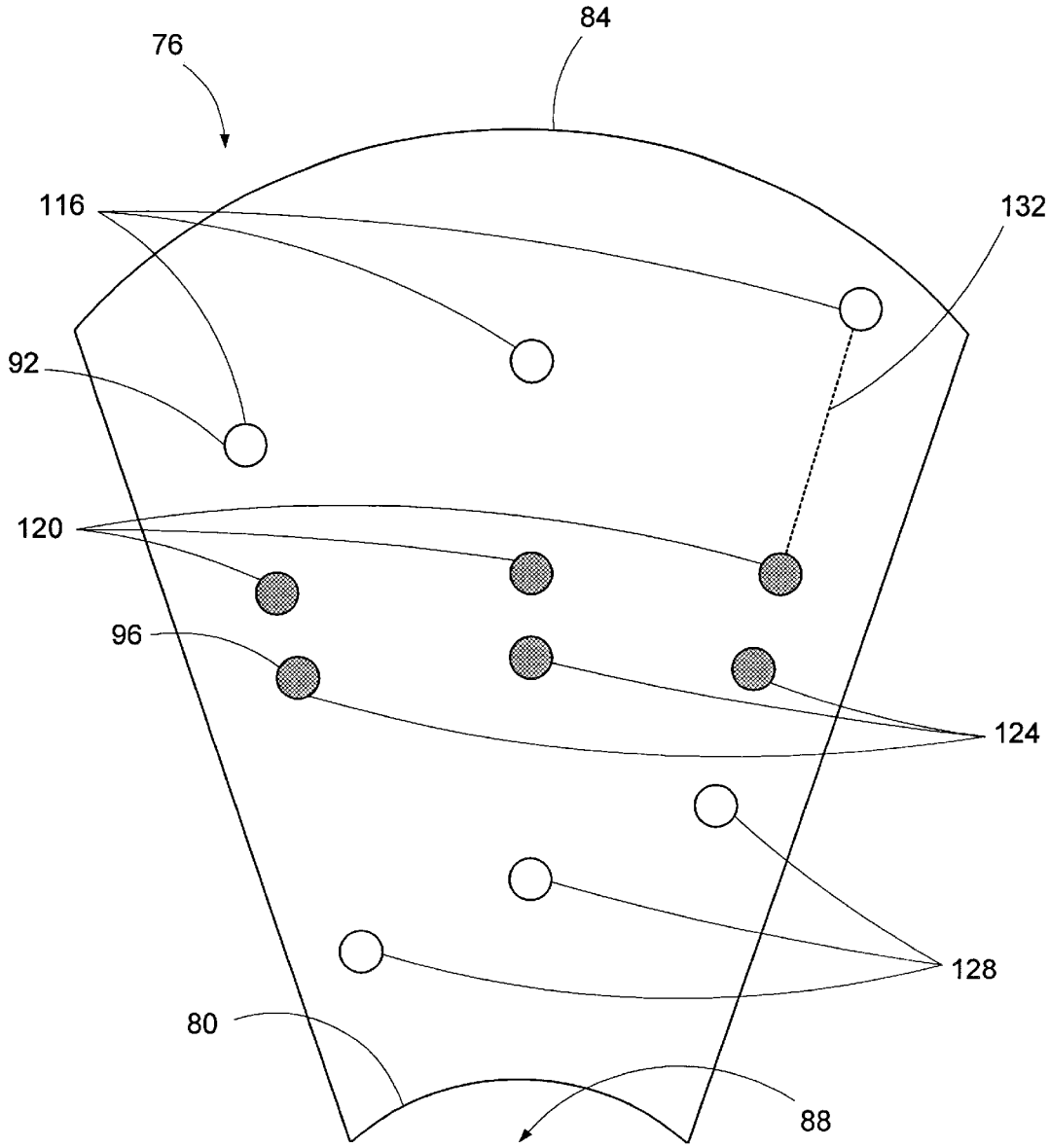
FIG. 5 is a top-view of a portion of a polishing pad having a plurality of electrodes positioned therein in accordance with one embodiment of the present invention.
Figure 6:
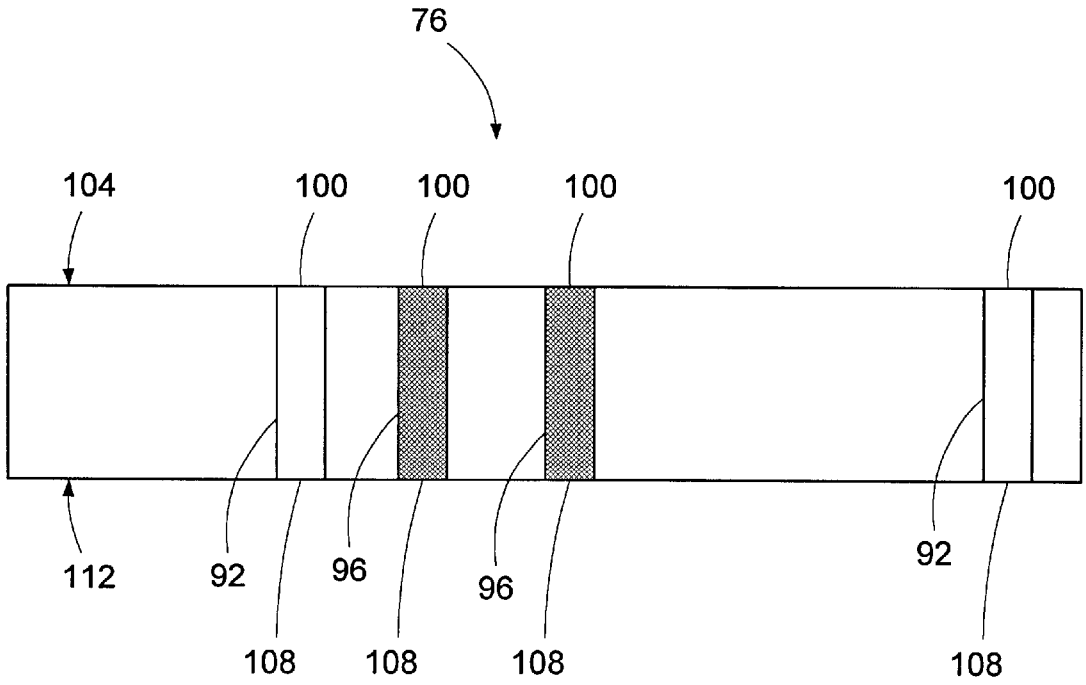
FIG. 6 is a cross-sectional view of the polishing pad illustrated in FIG. 5.

Referring to FIG. 5, a portion of a polishing pad 76 illustrating one embodiment of the present invention is shown. Although only a portion of the polishing pad 76 is shown, those skilled in the art will appreciate that the general configuration and dimensions of the polishing pad 76 may be similar to those illustrated in FIG. 4. Furthermore, although the polishing pad 76 is generally circular in shape, other configurations, shapes, and dimensions may be used with the present invention. In one embodiment, the polishing pad 76 is circular in configuration having an inner edge 80, an outer edge 84, and an opening 88 disposed therein.

The polishing pad 76 may be comprised of a variety of materials, such as polyurethane, and a plurality of response electrodes 92 and a plurality of sender electrodes 96 may be disposed therein. For example, referring to FIG. 6, a cross-sectional view of the polishing pad 76, illustrated in FIG. 5, is shown. In this embodiment, the sender and response electrodes 96, 92 have a length that is substantially equal to the thickness of the polishing pad 76. Moreover, these electrodes 96, 92 are shown having a first end 100 that is positioned substantially flush with a polishing surface 104 of the polishing pad 76, and a second end 108 that is substantially flush with a back surface 112 of the polishing pad 76.

Although the sender and response electrodes 96, 92 are shown having cylindrical shapes, the electrodes 96, 92 may be comprised of a variety of shapes and dimensions. For example, the electrodes 96, 92 may be square, triangular, hexagonal, or any other shape. In addition, the dimensions of the electrodes 96, 92 may also vary depending upon the application. In one embodiment, the electrodes 96, 92 are cylindrical having a height that is substantially equal to the thickness of the polishing pad 76 (e.g., 50 mil or 0.0254 mm) and a diameter of approximately 0.25 inches (6.35 mm).

Referring back to FIG. 5, the response electrodes 92 and the sender electrodes 96 may be arranged in a variety of configurations. Furthermore, the arrangement of the sender electrodes 96 and the response electrodes 92 may vary depending upon the particular application. In one illustrative embodiment, a first group 116 of response electrodes 92 may be staggered near the outer edge 84 of the polishing pad 76. In addition, a first group 120 of sender electrodes 96 may be positioned between the inner and outer edge 80, 84 of the polishing pad 76. In a similar manner, a second group 124 of sender electrodes 96 may be arranged adjacent to the first group 120 of sender electrodes 96, and a second group 128 of response electrodes 92 may be staggered near the inner edge 80 of the polishing pad 76. In this arrangement, as will be described below, when polishing an electrically conductive process layer (e.g., metal, polysilicon, etc.) of a wafer 24, an electrical path, illustrated by dotted line 132, may be established between the sender electrodes 96 and their corresponding response electrodes 92 through the conductive process layer being polished.

Although six sending electrodes 96 and six corresponding response electrodes 92 are shown, any number of sending electrodes 96 and response electrodes 92 may be positioned in the polishing pad 76. For example, rather than having a plurality of sending electrodes 96 and corresponding responds electrodes 92, a single pair of electrodes 96, 92 may be used. Furthermore, the electrode pattern, illustrated in FIG. 5, may be repeated in multiple location of the polishing pad 76. Alternatively, rather than repeating the same electrode pattern at various locations across the polishing pad 76, many different electrode patterns may be used within the same polishing pad 76. Moreover, the pattern may be symmetrical, asymmetrical, etc.

Figure 7:
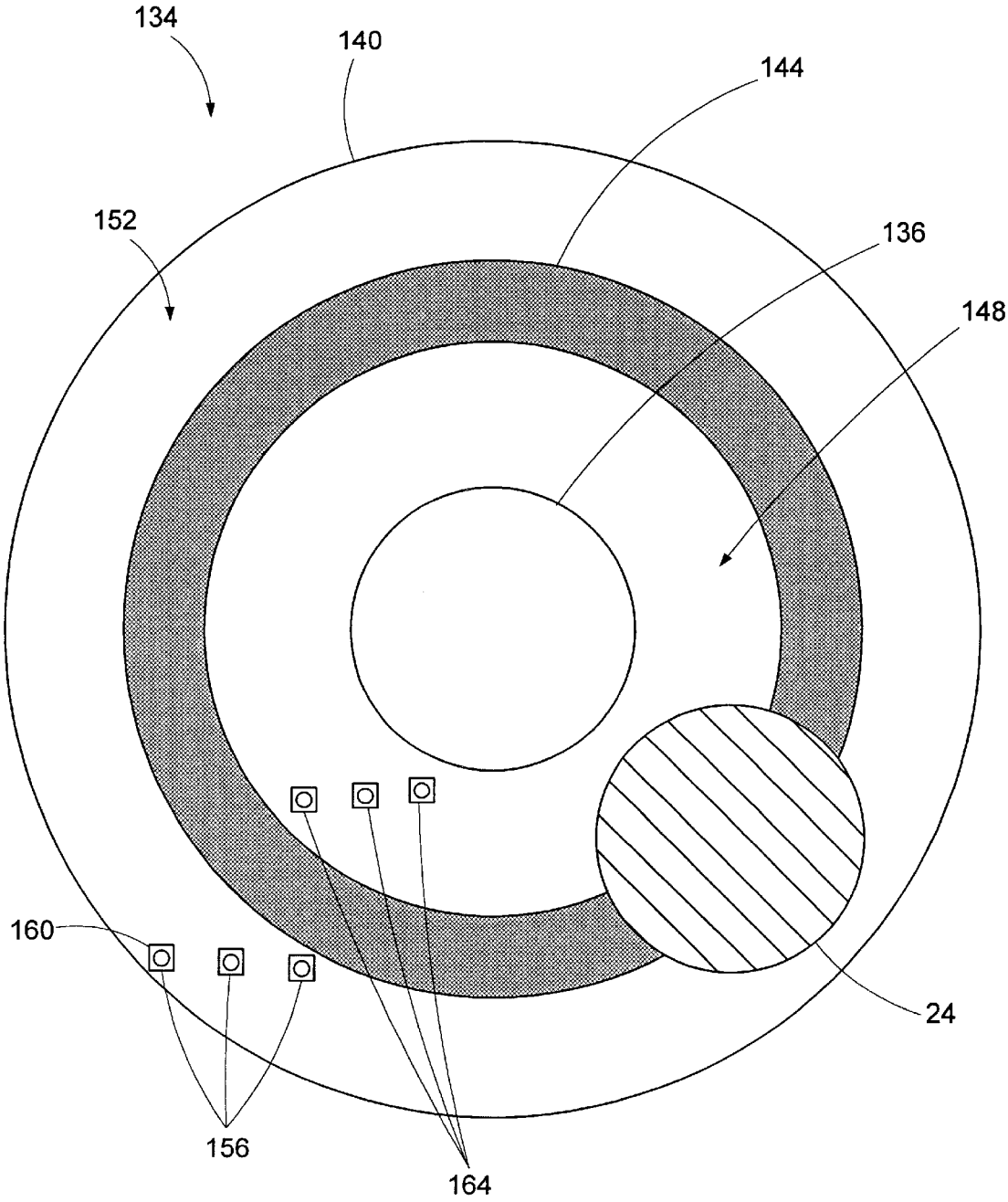
FIG. 7 is a top-view of an illustrative platen in accordance with one embodiment of the present invention.

Referring to FIG. 7, a platen 134 illustrating one embodiment of the present invention is shown. Generally, the shape and dimensions of the platen 134 are similar to the polishing pad 76. For example, in this embodiment, the platen 134 is circular and comprises an inner edge 136 and an outer edge 140. Furthermore, a power supply plane 144 is positioned between the inner and outer edge 136, 140 of the platen 134. The power supply plane 144 may be comprised of a variety of electrically conductive materials, such as copper, aluminum, gold, and the like.

Generally, the position and dimensions of the power supply plane 144 may be selected such that the second end 108 of the sending electrodes 96 are electrically coupled to the power supply plane 144 when the polishing pad 76 is fixed to the platen 134 (i.e., the sending electrodes are aligned with the power supply plane 144.) To simplify establishing the electrical connection between the power supply plane 144 and the sending electrodes 96, the second end 108 of the sending electrodes 96 may extend slightly beyond the back surface 112 of the polishing pad 76. Moreover, the surface area of the second end 108 of the sending electrodes 96 may be increased to enhance the electrical connection between the sending electrodes 96 and the power supply plane 144.

The power supply plane 144 may divide the surface of the platen 134 into an inner region 148 and an outer region 152. The outer region 152 of the platen 134 may have a first group 156 of contacts 160 positioned thereon. The first group 156 of contacts 160 may be aligned in a substantially similar pattern as the first group 116 of response electrodes 92, illustrated in FIG. 5. In a similar manner, the inner region 148 of the platen 134 may have a second group 164 of contacts 160 positioned thereon. The second group 164 of contacts 160 may be aligned in a substantially similar pattern as the second group 128 of response electrodes 92. With this arrangement, the polishing pad 76 may be aligned on the platen 134 such that the first and second groups 156, 164 of contacts 160 are mated (e.g., electrically coupled) with the first and second groups 116, 128 of response electrodes 92, respectively. As described above for the sending electrodes 96, the surface area of the second end 108 of the response electrodes 92 may be increased to simplify making the electrical connection between the response electrodes 92 and the contacts 160. In addition, the increased surface area of the second end 108 of the electrodes 92, 96 reduces the resistivity of the electrical connection.

In another embodiment, rather than having a power supply plane 144, additional contacts 160 may be positioned on the platen 134 in a configuration that aligns with sender electrodes 96 of the polishing pad 76. With this embodiment, each sender electrode 96 may be individually controlled. For example, individual signals may be provided to each sender electrode 96. As will be described below, during a polishing process, these individual signals may be passed through the conductive process layer of the wafer 24 and received by the adjacent corresponding response electrode 92 to determine endpoint of the polishing process.

Figure 8:
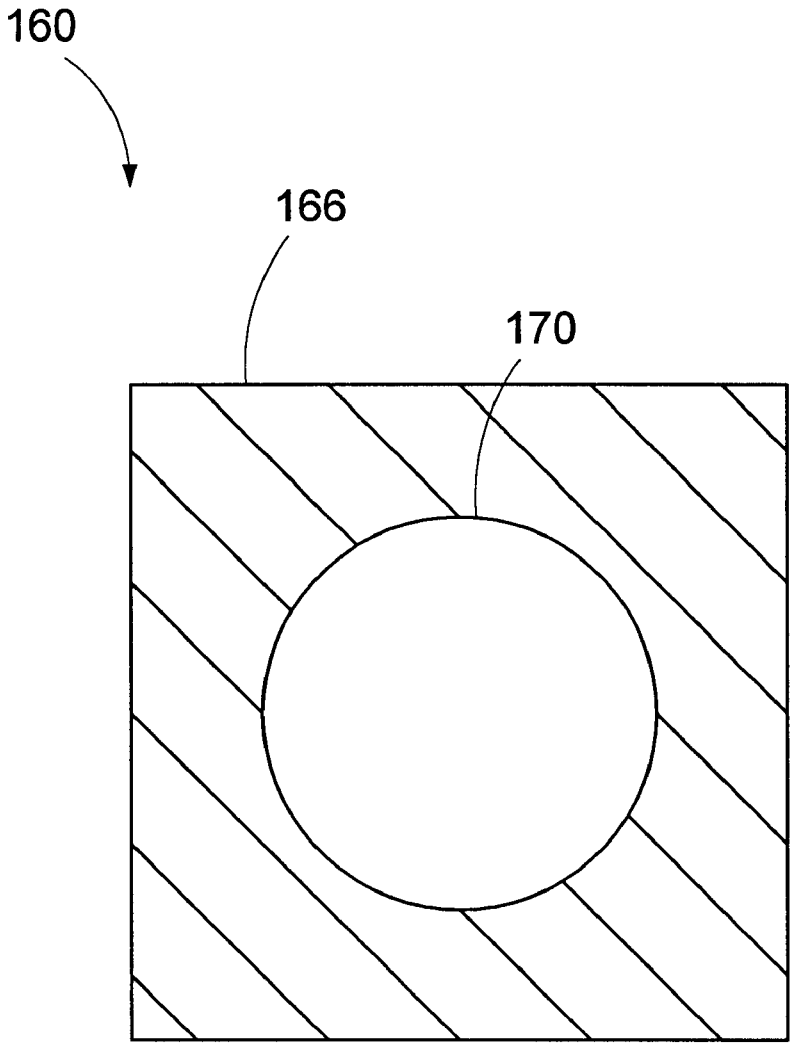
FIG. 8 is a top-view of a contact.

Referring to FIG. 8, one embodiment of the contacts 160 is shown. The contacts 160 may be comprised of an isolation region 166 and a conductive region 170. The isolation region 166 may be used to electrically isolate the conductive region 170 from the platen 134. Furthermore, the isolation region 166 may be comprised of a variety of materials having favorable insulating properties, such as ceramic, plastic, rubber, and the like. In another embodiment, rather than using the isolation region 166 to electrically isolate the conductive region 170, the platen 134 may be comprised of an insulating material. As described above, the response electrodes 92 may be electrically coupled to the contacts 160 by strategically positioning the polishing pad 76 on the platen 134. To facilitate the electrical connection, the conductive region 170 of the contacts 160 may be comprised of a variety of electrically conductive materials, such as copper, aluminum, gold, and the like.

Although the contacts 160 are shown having a circular conductive region 170 and a square isolation region 166, the contacts 160 may be comprised of a variety of shapes and dimensions. For example, the contacts 160 may be square, circular, hexagonal, or the like. In one embodiment, the conductive region 170 of the contacts 160 is circular and has a diameter of approximately 0.25 inches (6.35 mm), and the isolation region 166 is square and has an area of approximately 1 $in^2$ (12.7 $mm^2$).

Generally, the arrangement of the contacts 160 on the platen 134 corresponds with the arrangement of response electrodes 92 in the polishing pad 76. For example, in the embodiment illustrated in FIG. 7, six contacts 160 may be strategically positioned on the platen 134 to align with the six response electrodes 92 positioned within the polishing pad 76. However, to accommodate various electrode patterns used in different polishing pads 76, additional contacts 160 and power supply planes 144 may be positioned on a single platen 134. With this arrangement, only the relevant contacts 160 and power supply planes 144 corresponding with the electrodes 92, 96 of the current polishing pad 76 may be activated. Furthermore, by positioning additional contacts 160 and power supply planes 144 on one platen 134, the same polishing tool 36 may accommodate polishing pads 76 having different electrode patterns, thus, increasing the versatility of the polishing tool 36.

Referring back to FIG. 7, a wafer 24 is shown positioned above the platen 134. To simplify understanding of the present invention, the polishing pad 76 is not shown positioned between the wafer 24 and the platen 134. However, those skilled in the art will appreciate that during an actual polishing process, the polishing pad 76 is attached to the platen 134 and aligned such that the response electrodes 92 mate with the first and second groups 156, 164 of contacts 160. Furthermore, with the polishing pad 76 properly fixed to the platen 134, the sender electrodes 96 are electrically coupled to the power supply plane 144.

As described above, the wafer 24 may be positioned against the polishing pad 76, which for simplicity is not illustrated in FIG. 7. Generally, during a polishing process, the wafer 24 is rotated in a circular direction while being oscillated back and forth between the inner and outer edge 80, 84 of the polishing pad 76. Furthermore, the platen 134 may also be rotated in a circular direction at approximately 30–60 rpm. When polishing a conductive process layer of the wafer 24, a variety of control schemes may be used to determine endpoint of the polishing process. Furthermore, a variety of traditional endpoint techniques, such as monitoring carrier current, optical sensors, and the like, may be used in conjunction with the present invention.

In one embodiment, although not shown, the power supply plane 144 may be coupled to a signal source. For example, the process controller 28, illustrated in FIG. 1, may be coupled to the power supply plane 144 and used to generate a variety of signals. These signals may be delivered to the power supply plane 144 over the control line 32 during a polishing process. Moreover, if a conductive path exits through the process layer of the wafer 24, the signal may be received by the response electrodes 92 and returned back to the process controller 28 over the control line 32, which may also be attached to the contacts 160 positioned on the platen 134.

Depending upon the complexity of the system, a variety of signals may be applied to the power supply plane 144 of the platen 134. Generally, the signal selected may vary depending upon the particular application. In the simplest of embodiments, a DC current may be provided to the power supply plane 144. Furthermore, various analog signals having different frequencies and phase angles may be used. Alternatively, with complex systems, mixed signals having both a DC and an AC component may be implement with the present invention.

At the beginning of a polishing process, a conductive process layer (not shown) of the wafer 24 may be relatively thick. As the wafer 24 oscillates back and forth across the sender and response electrodes 92, 96 of the polishing pad 76, the power supply plane 144 may be energized with the electrical signal provided by the process controller 28. Because the sender electrodes 96 and the response electrodes 92 may communicate through the conductive process layer, the signal may be sent from the sender electrodes 96 and received by the response electrodes 92.

As the wafer 24 is polished, the conductive process layer is slowly removed, thus, exposing the underlying process layer or the semiconductor substrate of the wafer 24. When this occurs, the signal provided to the sender electrodes 96 may no longer be sent to a majority of the response electrodes 92 (i.e., an open circuit condition exits when the conductive process layer no longer couples the sender electrode 96 with its corresponding response electrode 92.) In one embodiment, once a predetermined number of the electrical paths are "open," endpoint of the polishing process may be determined. For example, the process controller 28 may monitor the response electrodes 92 of the polishing pad 76, and once 85%, 90%, 95%, or any other percentage of response electrodes 92 are determined not to be receiving the electrical signal from the sender electrodes 96, the polishing process may be determined to be complete. By using the response electrodes 92 and the sender electrodes 96 to determine endpoint for the polishing process, undesirable residual process layer remaining on the surface of the wafer 24 may be minimized.

To ensure the conductive process layer is completely removed from the wafer 24, an over polish process may be used with the endpoint control technique described above. For example, once endpoint is determined by monitoring the electrodes 92, 96, the polishing process may be extended for a short period of time (e.g., an over polish process), and any residual conductive process layer that may have escaped detection may be removed. One illustrative process may require 100 seconds of polishing before the process controller 28 determines that 80% of the response electrodes 92 are not receiving the signal from the sender electrodes 96 (i.e., endpoint of the polishing process.) When this occurs, the polishing process may be extended for 20 seconds, and any residual conductive process layer may be removed.

In another embodiment, rather than simply monitoring for open circuit conditions, the electrical characteristics of the signal received by the response electrodes 92 may be individually monitored and evaluated by the process controller 28, to determine the current state of the polishing process. For example, the amplitude of the signal provided by the process controller 28 may be compared with the amplitude of the signal received by the response electrodes 92. With this example, an attenuation of the signal may be used to determine the thickness of the conductive process layer. For example, thinner process layers having less mass may result in greater attenuation. Other signal characteristics that may be monitored include phase angle, harmonics, and the like.

After multiple polishing processes, the thickness of the polishing pad 76 may be gradually reduced. For example, a new polishing pad 76 may have a thickness of approximately 50 mils (1.27 mm), and at the end of its lifecycle, the polishing pad 76 may have a thickness of approximately 20 mils (0.508 mm). To prevent disruption of the polishing process, the sender and response electrodes 96, 92 may be designed to "wear" at substantially the same rate as the polishing pad 76. It is generally undesirable to have the first end 100 of the electrodes 92, 96 protrude or recess below the polishing surface 104 of the polishing pad 76.

In one embodiment, the electrodes 92, 96 may be comprised of graphite. Because graphite is a relatively soft material, during the polishing process, the first end 100 of the electrodes 92, 96 may wear at substantially the same rate as the polishing pad 76 without disrupting the polishing process. Other methods may be used to take advantage of the chemical properties of the slurry used during the polishing process. For example, because various slurries are selective to the process layer being polished, the electrodes 92, 96 may be comprised of the same material as the conductive process layer. With this example, during polishing, the slurry may not only remove the process layer of the wafer 24 but also attack the electrodes 92, 96 positioned in the polishing pad 76 causing them to wear with the polishing pad 76. In another embodiment, the first end 100 of the electrodes 92, 96 may be shaped as a brush (not shown). With this embodiment, the brush end of the electrode 92, 96 may contact the surface of the wafer 24 and any damage to the surface of the wafer 24 may be insignificant. Of course, other techniques may be used to prevent the electrodes 92, 96 from disrupting the polishing process.

Generally, the shape, composition, number, and position of the electrodes 92, 96 may vary depending upon the particular application. As described above, various electrode patterns may be implemented with the present invention. Furthermore, the electrodes 92, 96 may be comprised of a variety of conductive materials, such as copper, graphite, gold, aluminum, polysilicon, and the like.

Figure 9:
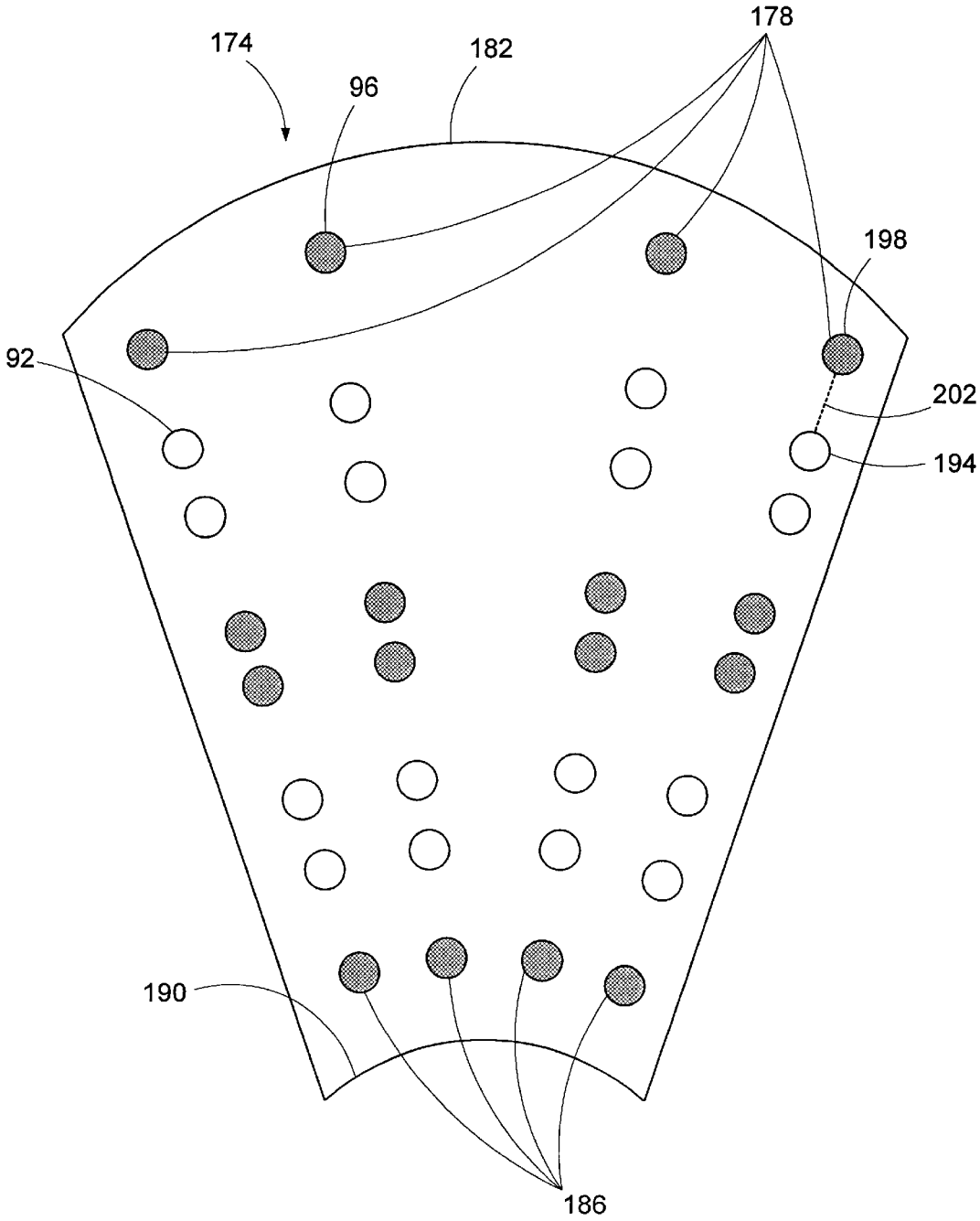
FIG. 9 is a top-view of a second illustrative portion of a polishing pad having a plurality of electrodes positioned therein in accordance with another embodiment of the present invention.

Referring to FIG. 9, a portion of a polishing pad 174 illustrating a second embodiment of the present invention is shown. Again, although only a portion of the polishing pad 174 is shown, those skilled in the art will appreciate that the general configuration and dimensions of the polishing pad 174 are similar to those illustrated in FIG. 4. Furthermore, although the polishing pad 174 is generally circular in shape, other configurations, shapes, and dimensions of the polishing pad 174 may be used with the present invention.

In this embodiment, a first group 178 of sender electrodes 96 are positioned adjacent to an outer edge 182 of the polishing pad 174, and a second group 186 of sender electrodes 96 are positioned adjacent to an inner edge 190 of the polishing pad 174. As described for the polishing pad 96 illustrated in FIG. 5, the first and second groups 178, 186 of sender electrodes 96 may communicate with corresponding response electrodes 92 through a conductive process layer of a wafer 24, during a polishing process. For example, when electrically coupled by the conductive process layer, response electrode 194 may receive an electrical signal from sender electrode 198, which is illustrated by dotted line 202. In addition, during polishing, similar conductive paths may be established, through the conductive process layer, between other pairs of sender and response electrodes 96, 92. Moreover, although only a portion of the wafer 174 is shown, the electrode pattern may be repeated in multiple locations of the polishing pad 174.

Figure 10:
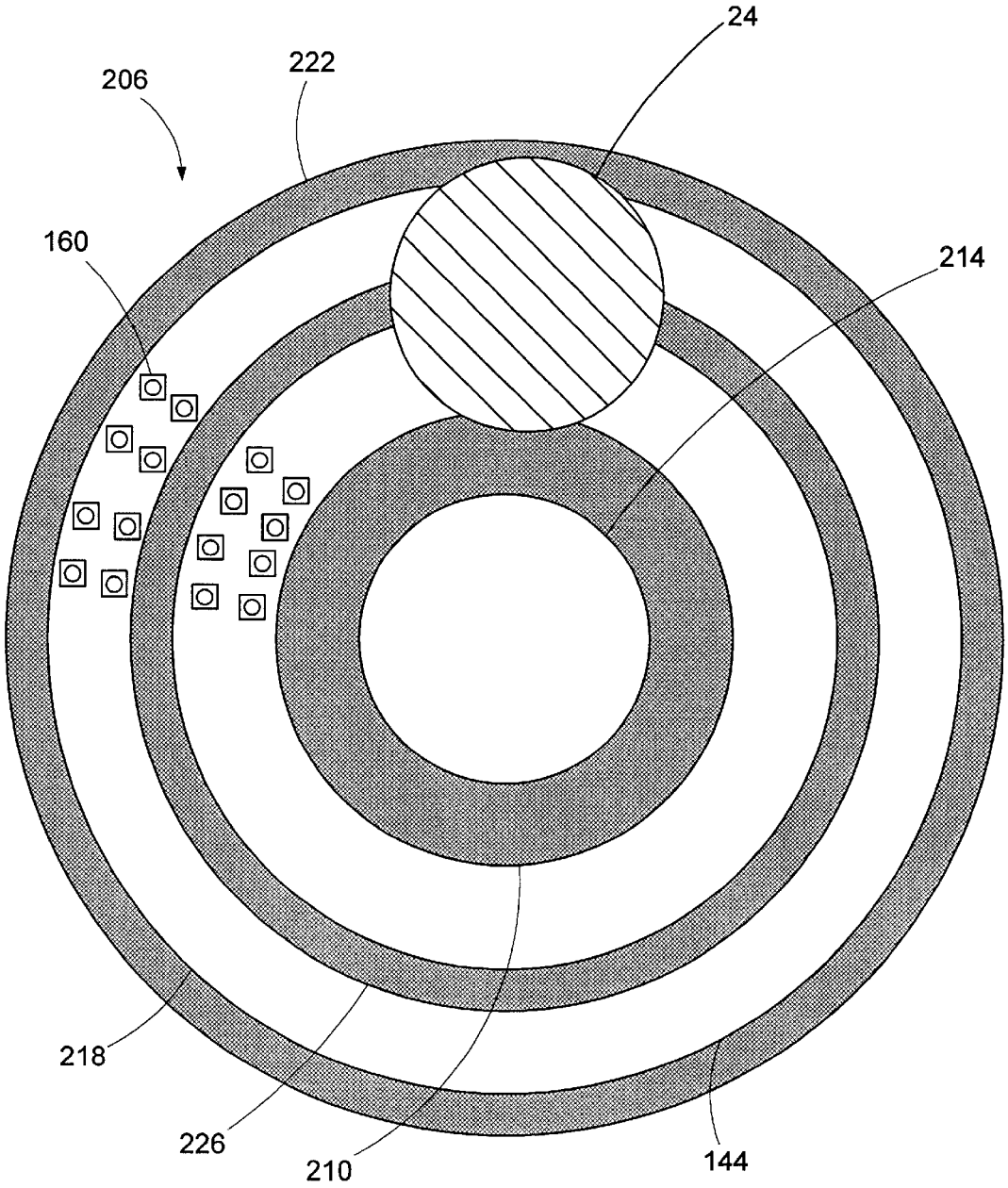
FIG. 10 is a top-view of a second illustrative platen in accordance with another embodiment of the present invention.

In FIG. 10, a platen 206 having power supply planes 144 and contacts 160 that correspond with the electrode arrangement of FIG. 9 is shown. In this embodiment, a first power supply plane 210 is positioned adjacent to an inner edge 214 of the platen 206, and a second power supply plane 218 is positioned adjacent to an outer edge 222 of the platen 206. Moreover, a third power supply plane 226 is positioned between the first and second power supply planes 210, 218. The polishing pad 174 may be aligned on the platen 206 such that the sender electrodes 96 align with one of the power supply planes 210, 218, 226, and the response electrodes 92 align with one of the contacts 160. Moreover, as described above, the sender and response electrodes 96, 92 may be used to determine endpoint for a polishing process.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A polishing pad of a polishing tool, comprising:

a polishing surface;

a back surface that is opposite the polishing surface;

at least one sender electrode disposed in the polishing pad, said at least one sender electrode being comprised of a first end positioned proximate the polishing surface, and a second end positioned proximate the back surface, the first end of the at least one sender electrode being comprised of a brush; and at least one response electrode disposed in the polishing pad, the at least one response electrode adapted to communicate with the at least one sender electrode through a conductive process layer of a wafer during a polishing process.

2. The polishing pad of claim 1, wherein the first end of the at least one sender electrode is substantially planar with the polishing surface.

3. The polishing pad of claim 1, wherein the second end of the at least one sender electrode is substantially planar with the back surface.

4. The polishing pad of claim 1, wherein the at least one response electrode is comprised of a first end positioned proximate the polishing surface, and a second end positioned proximate the back surface.

5. The polishing pad of claim 4, wherein the first end of the at least one response electrode is substantially planar with the polishing surface.

6. The polishing pad of claim 4, wherein the first end of the at least one response electrode is comprised of a brush.

7. The polishing pad of claim 4, wherein the second end of the at least one response electrode is substantially planar with the back surface.

8. The polishing pad of claim 1, wherein the at least one response electrode and the at least one sender electrode are comprised of the same material as the conductive process layer of the wafer.

9. The polishing pad of claim 1, wherein the at least one response electrode and the at least one sender electrode are comprised of at least one of the group of graphite, polysilicon, aluminum, gold, and copper.

10. A polishing system, comprising:

a polishing tool having a platen and a polishing pad, said platen adapted to have said polishing pad attached thereto, the polishing pad comprising:

a polishing surface;

a back surface that is opposite the polishing surface;

at least one sender electrode disposed in the polishing pad;

at least one response electrode disposed in the polishing pad;

at least one power supply plane positioned on said platen, said at least one sender electrode being aligned with said at least one power supply plane; and a controller coupled to the polishing tool.

11. The polishing system of claim 10, further comprising at least one contact positioned on the platen.

12. The polishing system of claim 11, wherein said at least one contact is comprised of at least one of the group of copper, aluminum, and gold.

13. The polishing system of claim 11 wherein said at least one response electrode comprises a second end and wherein an arrangement of the at least one contact corresponds with an arrangement of at least a portion of the at least one response electrode disposed in the polishing pad, and an electrical connection is established between the at least one contact and the second end of the at least one response electrode when the polishing pad is mated to the platen.

14. The polishing system of claim 10, wherein said at least one power supply plane positioned on the platen has a ring configuration defined by an inner edge and an outer edge.

15. The polishing system of claim 14, wherein said at least one sender electrode comprises a second end and wherein the location of the at least one power supply plane corresponds with an arrangement of the at least one sender electrode disposed in the polishing pad, and an electrical connection is established between the at least one power supply plane and the second end of the at least one sender electrode when the polishing pad is mated to the platen.

16. The polishing system of claim 10, wherein the at least one response electrode and the at least one sender electrode are comprised of the same material as the conductive process layer of the wafer.

17. The polishing system of claim 10, wherein the at least one sender electrode has a first end that is positioned proximate the polishing surface, and a second end that is positioned proximate the back surface.

18. The polishing system of claim 17, wherein the first end of the at least one sender electrode is substantially planar to the polishing surface of the polishing pad, and the second end of the at least one sender electrode is substantially planar to the back surface of the polishing pad.

19. The polishing system of claim 10, wherein the at least one response electrode has a first end that is positioned proximate the polishing surface, and a second end that is positioned proximate the back surface.

20. The polishing system of claim 19, wherein the first end of the at least one response electrode is substantially planar to the polishing surface of the polishing pad, and the second end of the at least one response electrode is substantially planar to the back surface of the polishing pad.

21. The polishing tool of claim 10, wherein the controller is adapted to:

provide a signal to the at least one sender electrode during a polishing process;

monitor the signal provided to the at least one sender electrode by monitoring the at least one response electrode, the at least one response electrode communicating with the at least one sender electrode through a conductive process layer of a wafer; and determine endpoint of the polishing process based on the signal received by the at least one response electrode.

22. The polishing process of claim 21, wherein the controller is adapted to:

monitor at least one response electrode of the polishing pad;

calculate a number of the at least one response electrode not receiving the signal from the at least one sender electrode; and determine endpoint of the polishing process based on a predetermined percentage of the at least one response electrodes not receiving the signal.

23. The polishing system of claim 21, wherein the controller is adapted to:

monitor the signal received by at least one response electrode;

measure a change in an electrical characteristic of the signal provided to the at least one sender electrode and the signal received by the at least one response electrode;

determine endpoint of the polishing process based on a predetermined change in an electrical characteristic of the signal.

24. A polishing pad of a polishing tool, comprising:

a polishing surface;

a back surface that is opposite the polishing surface;

at least one sender electrode disposed in the polishing pad, said at least one sender electrode being comprised of a first end positioned proximate the polishing surface, and a second end positioned proximate the back surface, the second end of the sender electrode being substantially planar with the back surface; and at least one response electrode disposed in the polishing pad, the at least one response electrode adapted to communicate with the at least one sender electrode through a conductive process layer of a wafer during a polishing process.

25. The polishing pad of claim 24, wherein the first end of the sender electrode is substantially planar with the polishing surface.

26. The polishing pad of claim 24, wherein the first end of the sender electrode is comprised of a brush.

27. The polishing pad of claim 24, wherein the at least one response electrode is comprised of a first end positioned proximate the polishing surface, and a second end positioned proximate the back surface.

28. The polishing pad of claim 27, wherein the first end of the at least one response electrode is substantially planar with the polishing surface.

29. The polishing pad of claim 27, wherein the first end of the at least one response electrode is comprised of a brush.

30. The polishing pad of claim 27, wherein the second end of the at least one response electrode is substantially planar with the back surface.

31. The polishing pad of claim 24, wherein the at least one response electrode and the at least one sender electrode are comprised of the same material as the conductive process layer of the wafer.

32. The polishing pad of claim 24, wherein the at least one response electrode and the at least one sender electrode are comprised of at least one of the group of graphite, polysilicon, aluminum, gold, and copper.

33. A polishing pad of a polishing tool, comprising:

a polishing surface;

a back surface that is opposite the polishing surface;

at least one sender electrode disposed in the polishing pad; and at least one response electrode disposed in the polishing pad, the at least one response electrode adapted to communicate with the at least one sender electrode through a conductive process layer of a wafer during a polishing process, said at least one response electrode being comprised of a first end positioned proximate the polishing surface, and a second end positioned proximate the back surface, the first end of the at least one response electrode being comprised of a brush.

34. The polishing pad of claim 33, wherein the at least one sender electrode is comprised of a first end positioned proximate the polishing surface, and a second end positioned proximate the back surface.

35. The polishing pad of claim 34, wherein the first end of the at least one sender electrode is substantially planar with the polishing surface.

36. The polishing pad of claim 34, wherein the first end of the at least one sender electrode is comprised of a brush.

37. The polishing pad of claim 34, wherein the second end of the at least one sender electrode is substantially planar with the back surface.

38. The polishing pad of claim 33, wherein the first end of the at least one response electrode is substantially planar with the polishing surface.

39. The polishing pad of claim 33, wherein the second end of the at least one response electrode is substantially planar with the back surface.

40. The polishing pad of claim 33, wherein the at least one response electrode and the at least one sender electrode are comprised of the same material as the conductive process layer of the wafer.

41. The polishing pad of claim 33, wherein the at least one response electrode and the at least one sender electrode are comprised of at least one of the group of graphite, polysilicon, aluminum, gold, and copper.

42. A polishing pad of a polishing tool, comprising:

a polishing surface;

a back surface that is opposite the polishing surface;

at least one sender electrode disposed in the polishing pad; and at least one response electrode disposed in the polishing pad, the at least one response electrode adapted to communicate with the at least one sender electrode through a conductive process layer of a wafer during a polishing process, said at least one response electrode being comprised of a first end positioned proximate the polishing surface, and a second end positioned proximate the back surface, the second end of the at least one response electrode being substantially planar with the back surface.

43. The polishing pad of claim 42, wherein the at least one sender electrode is comprised of a first end positioned proximate the polishing surface, and a second end positioned proximate the back surface.

44. The polishing pad of claim 43, wherein the first end of the at least one sender electrode is substantially planar with the polishing surface.

45. The polishing pad of claim 43, wherein the first end of the at least one sender electrode is comprised of a brush.

46. The polishing pad of claim 43, wherein the second end of the at least one sender electrode is substantially planar with the back surface.

47. The polishing pad of claim 42, wherein the first end of the at least one response electrode is substantially planar with the polishing surface.

48. The polishing pad of claim 42, wherein the first end of the at least one response electrode is comprised of a brush.

49. The polishing pad of claim 42, wherein the at least one response electrode and the at least one sender electrode are comprised of the same material as the conductive process layer of the wafer.

50. The polishing pad of claim 42, wherein the at least one response electrode and the at least one sender electrode are comprised of at least one of the group of graphite, polysilicon, aluminum, gold, and copper.

* * * * *